United States Patent [19]

Long et al.

[11] 4,329,821

[45] May 18, 1982

[54] COMPOSITE INSULATED WALL

[76] Inventors: Robert T. Long, 3216 Shasta Ct., NE., Cedar Rapids, Iowa 52402; Robert A. Weinhardt, 2037 Linden Dr., SE., Cedar Rapids, Iowa 52403

[21] Appl. No.: 145,150

[22] Filed: Apr. 30, 1980

[51] Int. Cl.[3] ..... E04C 2/26

[52] U.S. Cl. ..... 52/309.12; 52/314; 52/405; 52/410; 249/38

[58] Field of Search ..... 52/405, 407, 410, 314, 52/309.11, 309.12, 379, 699, 701; 249/96, 38, 42

[56] References Cited

U.S. PATENT DOCUMENTS

| | | | |
|---|---|---|---|
| 1,958,049 | 5/1934 | Kleitz | 249/38 |
| 2,339,489 | 1/1944 | Kublanow . | |
| 2,653,469 | 9/1953 | Callan | 52/410 |
| 2,718,138 | 9/1955 | Jones | 52/410 |
| 2,964,821 | 12/1960 | Meehan | 52/410 |
| 3,000,144 | 9/1961 | Kitson . | |
| 3,131,514 | 5/1964 | Siek . | |
| 3,300,931 | 1/1967 | Lutze . | |
| 3,304,676 | 2/1967 | Sallie et al. . | |
| 3,332,187 | 7/1967 | Arcari . | |
| 3,466,222 | 9/1969 | Curtis . | |
| 3,616,153 | 10/1971 | Downs . | |
| 3,646,715 | 3/1972 | Pope . | |
| 3,701,228 | 10/1972 | Taylor . | |
| 3,750,355 | 8/1973 | Blum . | |
| 3,798,861 | 3/1974 | Weiss . | |
| 3,816,234 | 6/1974 | Winfield . | |
| 3,879,908 | 4/1975 | Weismann . | |
| 3,927,857 | 12/1975 | Lovisa | 249/42 |
| 3,965,635 | 6/1976 | Renkert . | |
| 4,052,831 | 10/1977 | Roberts . | |
| 4,109,436 | 8/1978 | Berloty . | |

OTHER PUBLICATIONS

Polycell Industries Inc., Technical Bulletin, 1 page, no date.

Thermocurue Brochure, 2 pages, no date.

*Primary Examiner*—John E. Murtagh

*Attorney, Agent, or Firm*—Hill, Van Santen, Steadman, Chiara & Simpson

[57] ABSTRACT

A composite insulated wall includes a pair of outer poured concrete layers cured in a form and an organic or inorganic insulating panel or panels disposed between the concrete layers and retained in place by a number of lateral tie-rods extending through the insulating panel and into the concrete.

1 Claim, 12 Drawing Figures

FIG. 1
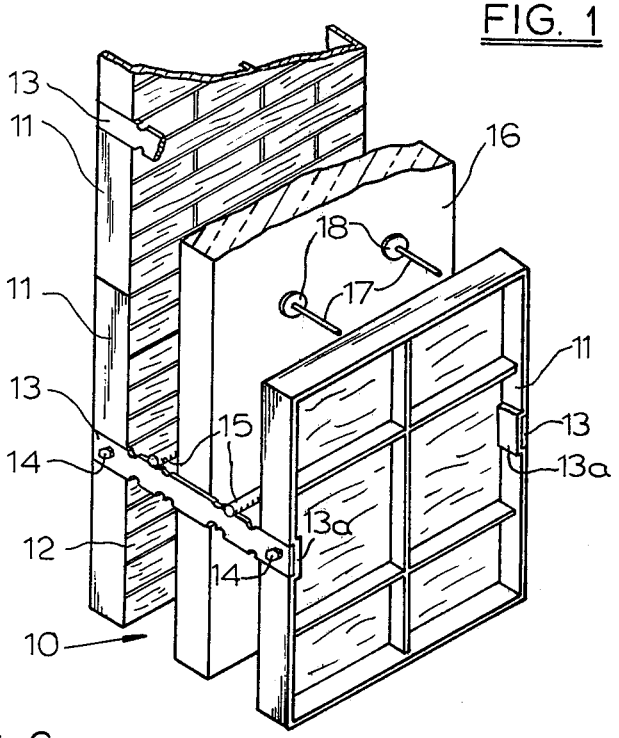
FIG. 7a
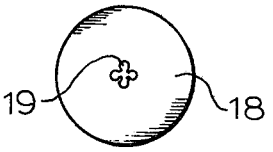
FIG. 6a
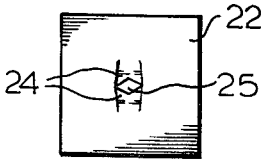
FIG. 6
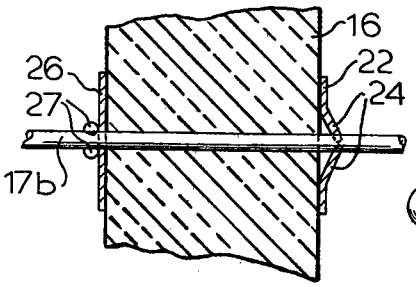
FIG. 7
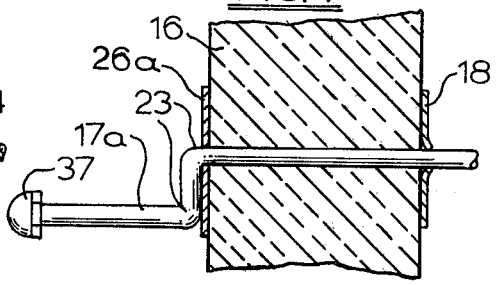
FIG. 8
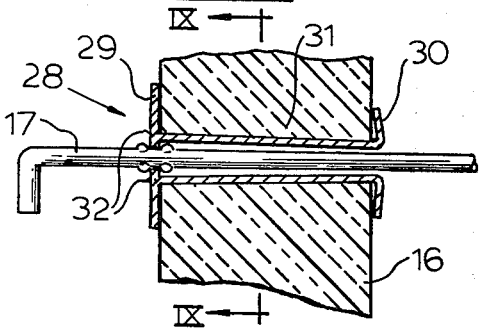
FIG. 10
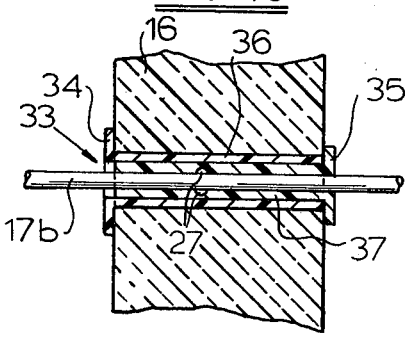
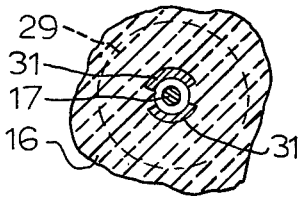
FIG. 9

FIG. 2
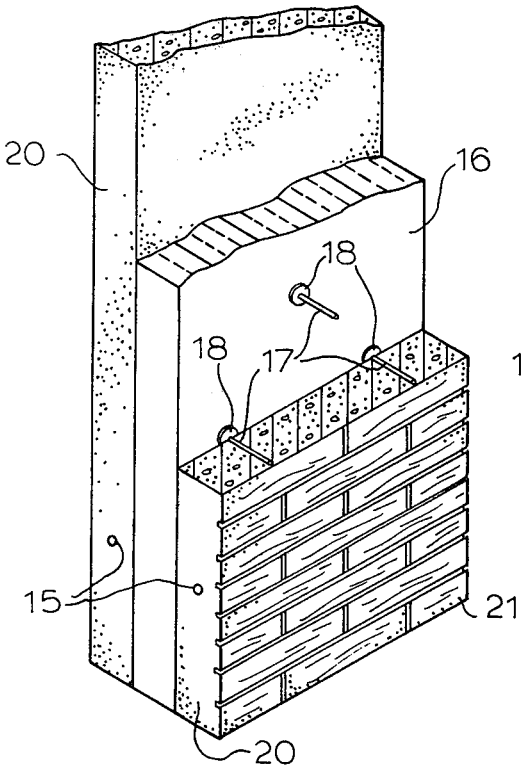
FIG. 5
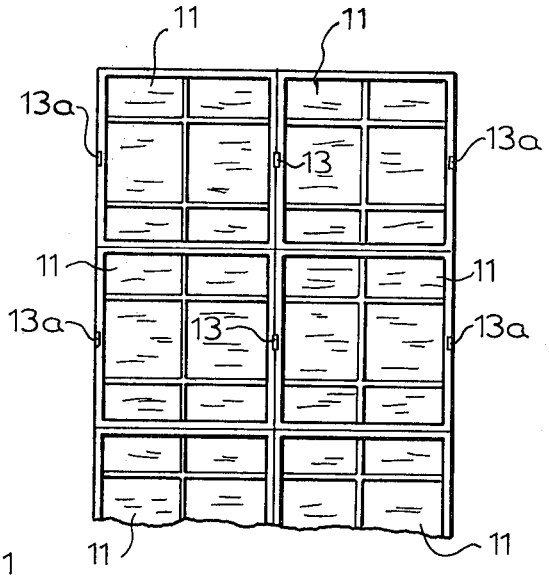
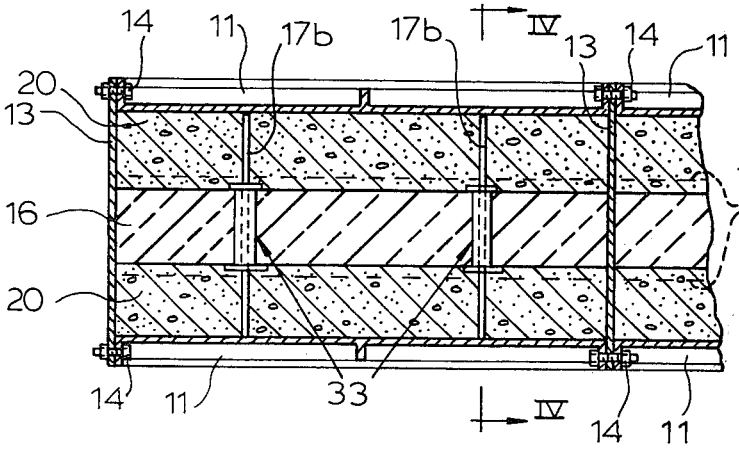
FIG. 3
FIG. 4
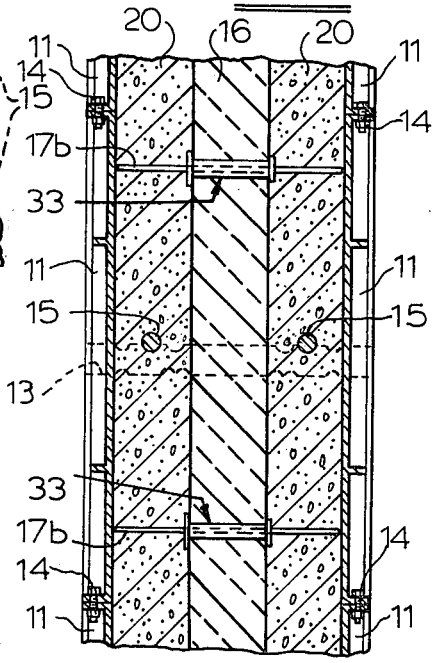

COMPOSITE INSULATED WALL

BACKGROUND OF THE INVENTION

1. Field of the Invention

The present invention relates to insulated walls, and in particular to such walls having outer layers of poured concrete and an inner insulating layer or layers of organic or inorganic rigid insulation board rigidly held therebetween.

2. Description of the Prior Art

It is well known in the construction industry to utilize metal or wooden forms to retain poured concrete during original hardening of the concrete.

It is also known in the construction industry to utilize a pair of opposed parallel outer slabs of concrete containing an inner layer of foamed insulation such as polyurethane to improve the insulation properties of poured walls. Such a structural combination is disclosed and claimed in U.S. Pat. No. 3,750,355.

It is known to pour concrete in forms with a sheet of polystyrene against one of the forms and after hardening moving that form to a new position and pouring second concrete face against the polystyrene and form in a second stage. This requires a two stage pour and extra labor to set part of the form twice. In addition, the contractor has his forms tied up for a longer period of time.

SUMMARY OF THE INVENTION

It is an object of the present invention to provide an insulating wall comprised of layers of concrete and insulating material in which the insulating material is monolithically retained as a part of the completed wall structure. The resulting wall can be structural or nonstructural but retains its insulating properties.

It is a further object of the present invention to provide a means for retaining an insulating panel between layers of poured concrete in an immovable fashion during the pouring of the concrete on both sides of the insulation.

The above objects are inventively achieved in an insulating wall comprised of outer layers of poured concrete with a polystyrene foam or other type of insulation board retained therebetween by a plurality of lateral tie-rods laterally affixed within the insulation board and extending substantially the entire lateral distance between outer surfaces of the concrete layers.

The insulation board panel has a plurality of tie-rods laterally affixed therein which extend substantially the entire distance between the form faces. The tie-rods are affixed to the insulation board to prevent lateral movement of the board during pouring of the concrete. These tie-rods hold the insulation board in the proper relationship to the form faces to allow pouring the proper thickness of concrete simultaneously on each side of the insulation board. The tie-rods adhere to the cured concrete on each side of the insulation board resulting in a completed wall structure having a high structural strength and high resistance to separation of the concrete layers from the insulation layer.

Several embodiments of holders are utilized to fix the lateral position of the tie-rods with respect to the insulating board panel. One structure for holding the tie-rods is a pre-formed plate having a central aperture therein surrounded by flaps which are flexible to an extent so as to permit insertion of the tie-rod in one direction, but rigid enough to retain the tie-rod between the flaps once inserted. Such plates must be fixed in place manually, and in order to eliminate the necessity of manually affixing such plates on both surfaces of the insulating board, the tie-rods can be provided with a stop which limits the distance which the tie-rod can be inserted into the insulating board, with the plate then being forced over the free end of the rod until it abuts the opposite surface of the board.

In another embodiment the retainer is a pair of joinable tubes which are inserted from opposite sides of the insulating board and carry a means such as the above-described flaps or a detent-receiver for laterally affixing the position of the tie-rod therein.

DESCRIPTION OF THE DRAWINGS

FIG. 1 is a perspective view of a form holding an insulating block therein having lateral tie-rods constructed in accordance with the principles of the present invention.

FIG. 2 is a perspective view, partly in section, of a wall cast in the forms of FIG. 1.

FIG. 3 is a plan elevational view of the concrete form of FIG. 1 including concrete poured therein.

FIG. 4 is a sectional view taken along line IV—IV of FIG. 3.

FIG. 5 is a side view of a number of sections of forms of the type shown in FIG. 1 joined together.

FIGS. 6 and 6*a* show an embodiment of a tie-rod retainer utilizing a square plate.

FIGS. 7 and 7*a* show an embodiment of a retainer utilizing a circular plate.

FIG. 8 shows an embodiment of a retainer utilizing a conical bore with flaps.

FIG. 9 is a sectional view taken along line IX—IX of FIG. 8.

FIG. 10 shows another embodiment of a tie-rod retainer utilzing mating cylindrical bores with detent means thereon.

DESCRIPTION OF THE PREFERRED EMBODIMENTS

A system for receiving poured concrete to form an insulating wall is generally referenced at 10 in FIG. 1. The structure 10 consists of opposed forms 11 each having a bricklike pattern on an interior surface 12 thereof. The forms may have any other pattern or be smooth. The forms 11 are held in generally parallel opposed fashion by a form tie 13 received in a correspondingly shaped indentation 13*a* in each panel 11, and held therein by pins 14 or other suitable form tie means. Reinforcing rods 15 may be supported by the form ties 13.

The insulating board 16 carries a number of tie-rods 17 laterally affixed therein by retainers 18, which may take several forms and are described in greater detail below. The tie-rods 17 extend substantially the entire distance between opposite forms 11 so that when concrete is poured into the space on either side of the insulating board 16 between the forms 11, the insulating board 16 will remain substantially immovable in the desired location between the forms. Moreover, as the poured concrete cures, the tie-rods 17 will be held within the concrete and form a structure comprised of outer layers of concrete and an inner insulating layer of insulating board 16 which is rigidly mechanically affixed therebetween. Such a completed wall structure is shown partly in section in FIG. 2, with the concrete layers referenced at 20. The rods 15 are of course retained in the cured concrete 20 and serve as further reinforcement therefor.

As can be seen in FIGS. 1 and 5, any number of panels 11 may be joined together to construct a wall of any desired dimensions.

Although any suitable insulating board 16 may be uilized, a particularly advantageous insulating board is polystyrene foam insulation board.

Sectional views of the structure of FIG. 1 including concrete poured therein are shown in FIGS. 3 and 4 including the retainer embodiment shown in FIG. 10, which will be described in greater detail below.

A number of different embodiments for retainers for fixing the lateral position of the tie-rods 17 with respect to the insulating board 16 are shown in FIGS. 6 through 10. The embodiments shown in FIGS. 6*a* and 7*a* utilize a plate which has a central aperture surrounded by flaps which permit insertion of the tie-rods 17 in one direction, however, abut the rod to prevent removal of the tie-rods 17 in an opposite direction. In order to minimize the time for manual attachment of each of the plate-type retainers on opposite sides of the board 16, in the embodiments shown in FIGS. 6 and 7, the rod is provided with structure to limit insertion of the rod into the board 16 so that only a single plate need be affixed to the rod on the opposite side of the board 16.

Turning now to a detailed discussion of each of the retainer means a square plate 22 is shown in FIGS. 6 and 6*a* which has a central aperture 25 surrounded on two sides by semi-flexible flaps 24. A tie-rod 17*b* is inserted through the aperture 25 in a first direction and is retained in place by the flaps 24 to prevent removal of the rod from the plate 22. The rod 17*b* is also inserted through a plate 26 having a central circular aperture until flanges 27 on the rod 17*b* abut the plate 26 at which time the plate 22 is forced against the board 16 to fix the lateral position of the rod 17*b* with respect to the board 16.

As shown in FIGS. 7 and 7*a*, a circular plate 18 may also be utilized having a central aperture 19 having a plurality of flaps therein which operates in a similar manner to the plate 22 to allow insertion of a rod 17*a* a certain distance in one direction, but prevents removal of the rod when pulled in an opposite direction. As shown in FIG. 7, a rod 17*a* has two right angle bends 23 therein to limit insertion of the rod 17*a* in the board 16 against a washer 26*a* so that the plate 18 can be forced against the board 16 to affix the position of the rod 17*a* therein. As also shown in FIG. 7, the ends of the rod 17*a* may be covered by a corrosion-resistant coating or cap 37 to minimize the formation of rust spots when the forms 11 are removed after the concrete has cured. Surface rusting on the concrete face can also be prevented by using corrosion-resistant rods.

It will be understood to those skilled in the art that the plate shown in FIG. 7*a* may be utilized with the flanges 27 in FIG. 6 and the plate 22 may be equally as well utilized with the right angle bends shown in FIG. 7.

Another retainer embodiment is shown in FIGS. 8 and 9 consisting of a conically tapering bore 31 which is formed by opposed sloping flanges. The flanges are inserted through the board 16 and the ends 30 thereof are bent outwardly upon exiting the board 30. Another flange 29 is carried on an opposite end of the retainer 28. A key-shaped opening allows the tie-rod 17 to be received and locked therein by turning it as it is inserted. Projections on the rod are locked on opposite sides of the key-shaped opening. Once the retainer 28 is affixed within the board 16, and the tie-rod affixed within the retainer 28, the lateral position of the tie-rod 17 becomes fixed.

A final retainer embodiment 33 is shown in FIG. 10 consisting of a first cylindrical element 36 having a flange 34 and further having an inner diameter which corresponds to the outer diameter of a second cylindrical element 37, which has a flange 35. The elements 36 and 37 are inserted within the insulating board 16 until the respective flanges 34 and 35 abut the opposite surfaces of the board 16. A tie-rod 17*b* having flanges 27 thereon is inserted into the retainer 33 which has a detent means therein for receiving the flanges 27, thereby affixing the position of the rod 17*b* with respect to the insulating board 16.

It will be apparent to those skilled in the art that the tie-rods 17 in addition to immovably holding the insulating board 16 between the forms 11 can be utilized to support reinforcing mesh or rods during pouring of the concrete.

Other modifications and changes may be suggested by those skilled in the art, however, it is the intention of the inventor to embody within the patent warranted hereon all changes and modifications as reasonably and properly come within the scope of his contribution to the art.

We claim as our invention:

1. An insulating wall comprising:

two spaced outer layers of form-poured concrete;

an interior layer or layers of organic or inorganic insulating material disposed between said outer layers;

a plurality of tie-rods extending perpendicularly through said insulating layer or layers and further extending substantially from respective outer surfaces of said outer layers;

a plurality of retainer means mounted to receive and immovably hold a tie-rod for fixing the lateral position of said tie-rods with respect to said insulation layer, each of said retainer means consisting of a first cylindrical element having one flanged end, a second cylindrical element having one flanged end, said second cylindrical element having an outer diameter substantially equal to the inner diameter of said first cylindrical element and receivable therein, said first and second cylindrical elements being inserted in said interior layer at opposite sides thereof until said respective flanges abut said interior layer, a detent means carried in the interior of said second cylindrical element, a pair of flanges carried on each said tie-rod receivable in said detent means in said second cylindrical element to lock said tie-rod with respect to said interior layer, whereby said tie-rods abut said form during pouring of said concrete to retain said interior layer or layers substantially immovably during pouring and are retained in said concrete after curing for forming a mechanical connection between said interior layer or layers and each of said outer layers.

* * * * *